US008135293B2

(12) United States Patent
Yamaguchi et al.

(10) Patent No.: US 8,135,293 B2
(45) Date of Patent: Mar. 13, 2012

(54) IMAGE FORMING APPARATUS AND APPARATUS

(75) Inventors: Yoji Yamaguchi, Ebina (JP); Tomoya Ichikawa, Ebina (JP); Mihoko Tanaka, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 451 days.

(21) Appl. No.: 12/389,597

(22) Filed: Feb. 20, 2009

(65) Prior Publication Data

US 2010/0080579 A1 Apr. 1, 2010

(30) Foreign Application Priority Data

Sep. 29, 2008 (JP) ..... 2008-250538

(51) Int. Cl.
*G03G 21/12* (2006.01)
*G03G 21/00* (2006.01)

(52) U.S. Cl. ..... 399/35; 399/358

(58) Field of Classification Search ..... 399/35, 399/99, 120, 252, 358, 360
See application file for complete search history.

(56) References Cited

U.S. PATENT DOCUMENTS 7,965,972 B2 * 6/2011 Ichikawa et al. ..... 399/358
2008/0075483 A1 * 3/2008 Bito et al. ..... 399/35
2010/0080578 A1 * 4/2010 Ichikawa ..... 399/34
2010/0080580 A1 * 4/2010 Yamaguchi et al. ..... 399/35
2010/0080637 A1 * 4/2010 Yamaguchi et al. ..... 399/358

FOREIGN PATENT DOCUMENTS

JP 63-002091 1/1988

* cited by examiner

*Primary Examiner* — David Gray
*Assistant Examiner* — Frederick Wenderoth
(74) *Attorney, Agent, or Firm* — Morgan, Lewis & Bockius LLP

(57) ABSTRACT

The image forming apparatus includes: an image forming section forming an image on a recording medium; an attachable and detachable storing container storing waste powder discarded and transported from the image forming section; a transport path for transporting the waste powder; a first discharging part allowed to be shut off and discharging the waste powder to an outside of the transport path; a second discharging part provided downstream of the first discharging part in a transporting direction and discharging the waste powder to the storing container; a powder storage part storing the waste powder when the storing container is removed; and a controller causing the shut first discharging part to be opened when the storing container is removed, and causing the waste powder to be discharged from the first discharging part. The powder storage part has capacity enough for storing the waste powder when the first discharging part is opened.

11 Claims, 7 Drawing Sheets

IMAGE FORMING APPARATUS AND APPARATUS

CROSS REFERENCE TO RELATED APPLICATIONS

This application is based on and claims priority under 35 USC §119 from Japanese Patent Application No. 2008-250538 filed Sep. 29, 2008.

BACKGROUND

1. Technical Field

The present invention relates to an image forming apparatus such as a copy machine or a printer, and an apparatus.

2. Related Art

Some image forming apparatuses are provided with a recovery device that recovers, as a waste toner, a toner that has not been used for image formation.

SUMMARY

According to an aspect of the present invention, there is provided an image forming apparatus including: an image forming section that forms an image on a recording medium; a storing container that is attachably and detachably provided and that stores waste powder having been discarded and transported from the image forming section; a transport path through which the waste powder from the image forming section is transported; a first discharging part that is provided so as to be allowed to be shut off, and that discharges, to an outside of the transport path, the waste powder having been transported through the transport path; a second discharging part that is provided downstream of the first discharging part in a transporting direction of the waste powder and that discharges, to the storing container, the waste powder having been transported through the transport path; a powder storage part that stores the waste powder having been transported through the transport path and discharged from the second discharging part, when the storing container is removed; and a controller that causes the first discharging part having been shut off to be opened when the storing container is removed, and that causes the waste powder transported from an upstream of the first discharging part in the transporting direction of the waste powder to be discharged from the first discharging part. The powder storage part has a capacity that is enough for storing the waste powder located downstream of the first discharging part in the transporting direction of the waste powder when the first discharging part is caused to be opened by the controller.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described in detail below with reference to the accompanying drawings.

Figure 1:
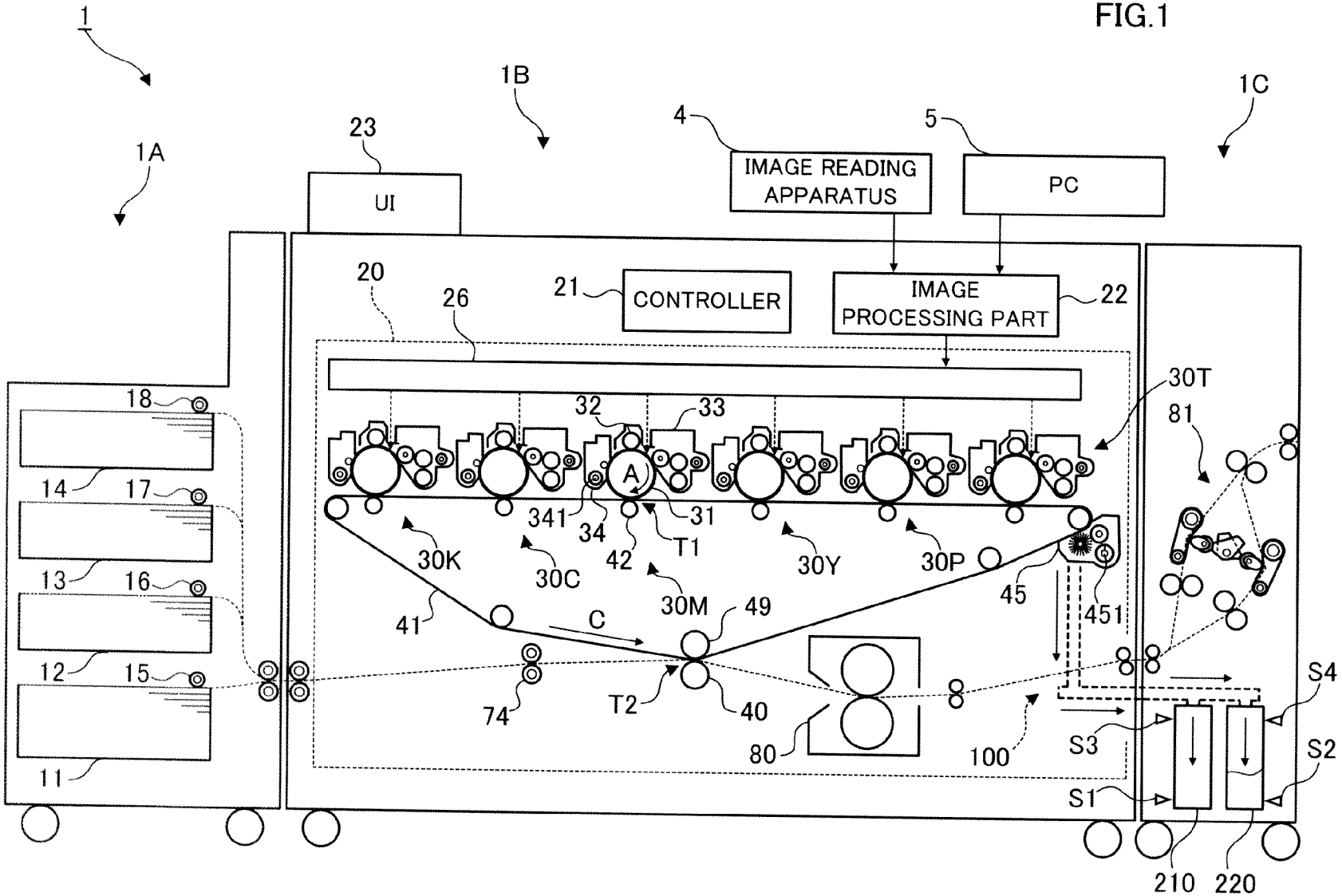
FIG. 1 is a diagram showing a configuration of a digital color printer as an example of an image forming apparatus to which the exemplary embodiment is applied.

FIG. 1 is a diagram showing a configuration of a digital color printer as an example of an image forming apparatus to which the exemplary embodiment is applied.

An image forming apparatus 1 of the present exemplary embodiment includes a sheet feeding unit 1A, an image formation unit 1B, and a sheet outputting unit 1C.

The sheet feeding unit 1A includes a first sheet storage part 11 to a fourth sheet storage part 14, each of which stores paper sheets serving as an example of a recording medium. The sheet feeding unit 1A further includes sending rolls 15 to 18 provided respectively for the first to fourth sheet storage parts 11 to 14. The sending rolls 15 to 18 send paper sheets stored in the respective sheet storage parts 11 to 14 to transport paths each connected to the image formation unit 1B.

The image formation unit 1B is of a so-called tandem type, and includes an image forming process part 20, a controller 21, and an image processing part 22. The image forming process part 20 forms an image on a paper sheet. The controller 21 controls the image forming process part 20 and the like. The image processing part 22 is connected, for example, to an image reading apparatus 4 and a personal computer (PC) 5, and performs image processing on image data received from these devices. The image formation unit 1B further includes a user interface (UI) 23 that has a display device and the like, and that gives information to the user and receives information inputted by the user.

The image forming process part 20, as an example of an image forming section, is provided with six image forming units 30T, 30P, 30Y, 30M, 30C, and 30K (hereinafter, sometimes referred to simply as "image forming units 30") arranged in parallel at intervals. Each image forming unit 30 includes a photoconductor drum 31, a charging roll 32, a developing device 33, and a cleaning unit 34. An electrostatic latent image is formed on the photoconductor drum 31 while the photoconductor drum 31 is rotating in a direction indicated by an arrow A in the figure. The charging roll 32 electrically charges a surface of the photoconductor drum 31 uniformly. The developing device 33 develops the electrostatic latent image formed on the photoconductor drum 31. The cleaning unit 34 removes an untransferred toner and the like on the surface of the photoconductor drum 31. In addition, the image forming process part 20 is provided with a laser exposure device 26 that scans and exposes, with a laser beam, the photoconductor drums 31 of the respective image forming units 30T, 30P, 30Y, 30M, 30C, and 30K.

Here, all the image forming units 30 have almost the same configuration except for the toner stored in the respective developing devices 33. Yellow (Y), magenta (M), cyan (C), and black (K) toner images are formed in the image forming units 30Y, 30M, 30C, and 30K, respectively.

Meanwhile, in addition to the commonly-used four colors (normal colors), that is, yellow, magenta, cyan, and black, another image forming material is sometimes desired to be used in the forming of an image on a paper sheet. Specifically, there is a case where an image is desired to be formed on a paper sheet by using an image forming material, such as a spot color, that is difficult or impossible to be expressed with the commonly-used four colors. For example, an image is sometimes desired to be formed on a paper sheet by using a toner, such as a toner of a corporate color dedicated to a specific user, a foam toner for Braille, a fluorescent toner, a toner that improves a gloss, a ferromagnetic toner, an invisible toner having sensitivity to the infrared region, or the like.

For this reason, the image formation unit 1B of the present exemplary embodiment is provided with image forming units 30T and 30P that achieve image formation using a spot color and the like, in addition to the generally-mounted image forming units 30Y, 30M, 30C, and 30K.

Moreover, the image forming process part 20 includes an intermediate transfer belt 41, primary transfer rolls 42, a secondary transfer roll 40, a belt cleaner 45, and a fixing device 80. Onto the intermediate transfer belt 41, various color toner images formed on the photoconductor drums 31 of the respective image forming units 30 are superimposedly transferred. The primary transfer rolls 42 sequentially transfer (primarily transfer) the various color toner images of the respective image forming units 30 onto the intermediate transfer belt 41 at primary transfer portions T1. The secondary transfer roll 40 transfers (secondarily transfers) the superimposed toner images, which have been transferred onto the intermediate transfer belt 41, together onto a paper sheet at a secondary transfer portion T2. The belt cleaner 45 removes an untransferred toner and the like on the surface of the intermediate transfer belt 41. The fixing device 80 fixes a secondarily transferred image onto the paper sheet.

The image forming process part 20 performs an image forming operation on the basis of control signals sent from the controller 21. First, image data inputted through the image reading apparatus 4 or the PC 5 are subjected to image processing by the image processing part 22, and then supplied to the laser exposure device 26. Then, for example, in the magenta (M) image forming unit 30M, after the surface of the photoconductor drum 31 is uniformly charged with a potential set in advance, by the charging roll 32, the photoconductor drum 31 is scanned and exposed by the laser exposure device 26 with a laser beam modulated according to the image data acquired from the image processing part 22. In this way, an electrostatic latent image is formed on the photoconductor drum 31. The electrostatic latent image thus formed is developed by the developing device 33, so that a magenta toner image is formed on the photoconductor drum 31. In the same manner, yellow, cyan, and black toner images are formed in the respective image forming units 30Y, 30C, and 30K, and also, toner images of spot colors or the like are formed in the respective image forming units 30T and 30P.

These color toner images having been formed in the respective image forming units 30 are electrostatically transferred (primarily transferred) in sequence by the corresponding primary transfer rolls 42 onto the intermediate transfer belt 41 rotating in a direction indicated by an arrow C in FIG. 1, so that superimposed toner images are formed on the intermediate transfer belt 41.

On the other hand, the untransferred toner and the like remaining on each photoconductor drum 31 at the primary transfer are removed (wasted) by the cleaning unit 34 disposed downstream of the primary transfer roll 42. Each cleaning unit 34 includes a transporting member 341 provided along an axial direction of the photoconductor drum 31. The transporting member 341 transports the removed untransferred toner and the like to a rear side (back part side) of the image formation unit 1B. The untransferred toner and the like (waste powder, powder) transported by the transporting member 341 to the rear side of the image formation unit 1B are then transported by a transporting mechanism 100 to a first storing container 210 or a second storing container 220. Here, the transporting mechanism 100 is provided also in the rear side of the image formation unit 1B, while the first and second storing containers 210 and 220 are both detachably and attachably provided in the sheet outputting unit 1C.

Here, in the present exemplary embodiment, two storing containers are provided. Specifically, the two storing containers are the first storing container 210 (an example of different storing container) and the second storing container 220. Accordingly, for example, even if any one of the storing containers is filled up, this configuration allows an image forming operation to be continuously performed by transporting the untransferred toner and the like to the other one of the storing containers. Moreover, for example, this configuration also allows a reduction in weight of the storing container that contains the untransferred toner and the like therein when the storing container is detached, as compared with a configuration in which the untransferred toner and the like are stored in a single storing container having a large capacity.

In addition, in the present exemplary embodiment, a first sensor S1 and a second sensor S2 are provided. The first sensor S1 performs detection on the first storing container 210, while the second sensor S2 performs detection on the second storing container 220. In addition, a third sensor S3 is provided. The third sensor S3 outputs a signal set in advance, when the untransferred toner and the like reach an upper portion of the first storing container 210 (when the first storing container 210 is filled up with the untransferred toner and the like). Furthermore, a fourth sensor S4 is provided. The fourth sensor S4 outputs a signal set in advance, when the untransferred toner and the like reach an upper portion of the second storing container 220 (when the second storing container 220 is filled up with the untransferred toner and the like).

Note that, although the first storing container 210 and the second storing container 220 are provided in the sheet outputting unit 1C in the present exemplary embodiment, these storing containers may be provided alternatively in the image formation unit 1B.

On the other hand, the superimposed toner images formed on the intermediate transfer belt 41 are transferred, according to the movement of the intermediate transfer belt 41, toward the secondary transfer portion T2 in which the secondary transfer roll 40 and a backup roll 49 are disposed. Meanwhile, the paper sheet is transferred to a position of a registration roll 74 after being taken out of, for example, the first sheet storage part 11 by the sending roll 15 and then passing through the transport path.

At the timing when the superimposed toner images are transported to the secondary transfer portion T2, the paper sheet is fed to the secondary transfer portion T2 from the registration roll 74. Then, the superimposed toner images are electrostatically transferred (secondarily transferred) together onto the paper sheet by the action of a transfer electric field formed between the secondary transfer roll 40 and the backup roll 49 at the secondary transfer portion T2.

Thereafter, the paper sheet having the superimposed toner images electrostatically transferred thereon is peeled from the intermediate transfer belt 41, and then, is transported to the fixing device 80. The unfixed toner images on the paper sheet having been transported to the fixing device 80 are subjected to a fixing process with heat and pressure by the fixing device 80 so as to be fixed onto the paper sheet. Then, the paper sheet having a fixed image formed thereon passes through a curl correcting part 81 provided in the sheet outputting unit 1C, and then, is transported to an outputted-sheet stacking unit (not shown in the figure).

On the other hand, the untransferred toner and the like remaining on the surface of the intermediate transfer belt 41 after the secondary transfer are removed by the belt cleaner 45, which is disposed in contact with the intermediate transfer belt 41, after the completion of the secondary transfer. The belt cleaner 45 includes a transporting member 451 that is provided to extend from the front side to the rear side of the image formation unit 1B, and that transports the untransferred toner and the like thus removed to the rear side of the image formation unit 1B. Then, the untransferred toner and the like transported to the rear side of the image formation unit 1B by the transporting member 451 are transported to the first storing container 210 or the second storing container 220 by the transporting mechanism 100. Note that, in the specification, the untransferred toner and the like transported from the cleaning unit 34 and the belt cleaner 45 to the transporting mechanism 100 are hereinafter referred to as a waste toner.

Subsequently, the transporting mechanism 100 will be described in detail.

Figure 2:
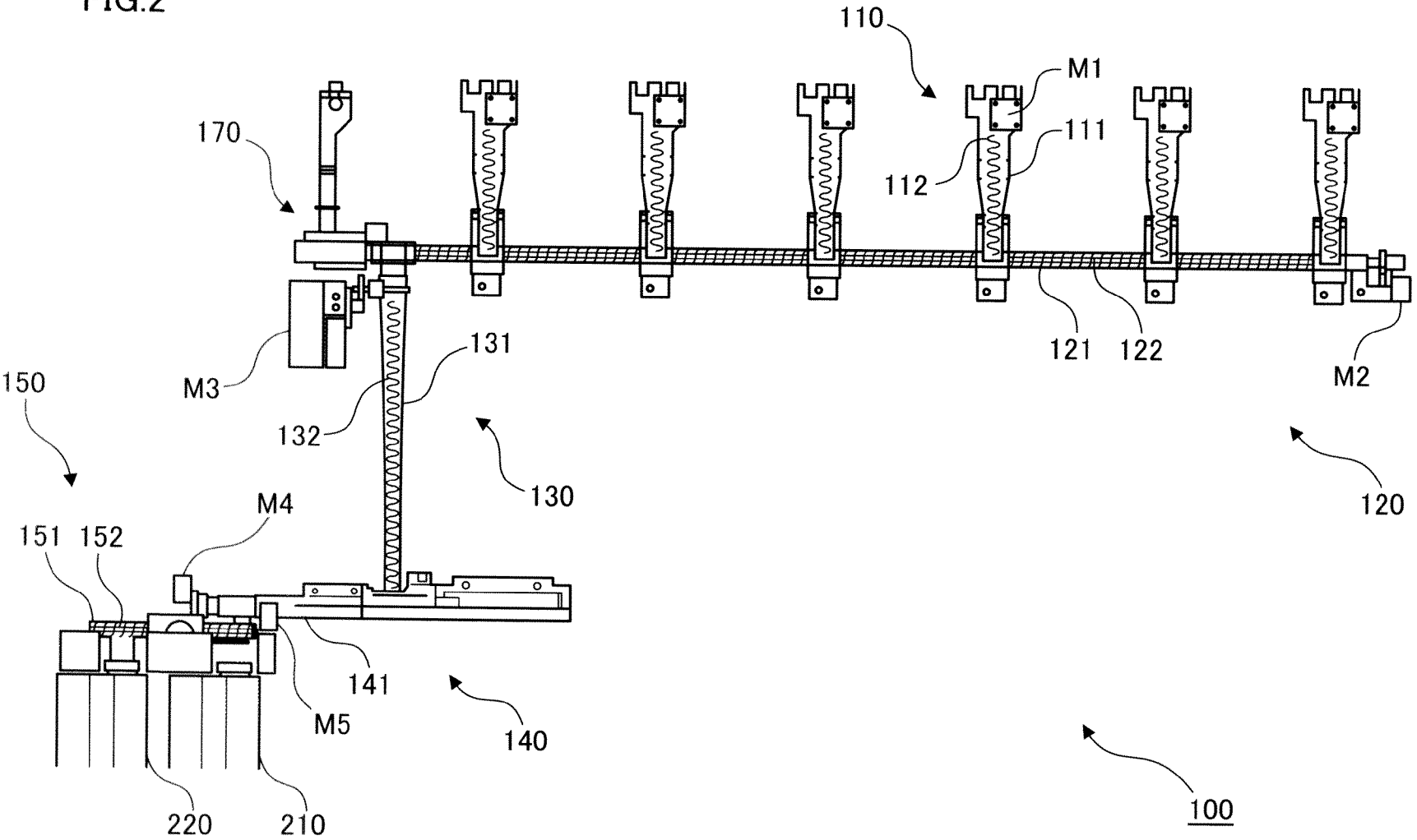
FIG. 2 is a diagram showing the transporting mechanism from the rear side of the image forming apparatus.

FIG. 2 is a diagram showing the transporting mechanism 100 from the rear side of the image forming apparatus 1.

As shown in FIG. 2, the transporting mechanism 100 includes first transporting mechanisms 110 that are provided corresponding to the respective image forming units 30, and that transport the waste toner from the cleaning units 34. In addition, the transporting mechanism 100 includes a discharging part 170 to which the waste toner from the belt cleaner 45 is discharged. Moreover, the transporting mechanism 100 includes a second transporting mechanism 120, a third transporting mechanism 130, a fourth transporting mechanism 140, and a fifth transporting mechanism 150. The second transporting mechanism 120 transports the waste toner having been transported by the first transporting mechanisms 110 and the waste toner having been discharged from the discharging part 170. The third transporting mechanism 130 transports the waste toner having been transported by the second transporting mechanism 120. The fourth transporting mechanism 140 transports the waste toner having been transported by the third transporting mechanism 130, and the fifth transporting mechanism 150 transports, to the first storing container 210 or the second storing container 220, the waste toner having been transported by the fourth transporting mechanism 140.

Each first transporting mechanism 110 includes a tubular member 111, a coil spring 112, and a first motor M1. The tubular member 111 forms a transport path for the waste toner having been transported by the transporting member 341 (see FIG. 1) provided to the cleaning unit 34. The coil spring 112, which is an example of a breaking member, is provided inside the tubular member 111 and breaks down the waste toner adhering to an inner wall surface of the tubular member 111 by reciprocating along the tubular member 111. The first motor M1 rotationally drives the transporting member 341 and causes the coil spring 112 to reciprocate.

Each tubular member 111 is provided to extend in the up and down direction (the approximately vertical direction). Accordingly, the waste toner having been transported by the transporting member 341 falls down inside this tubular member 111.

Each coil spring 112 is formed of a wire, and has a helical (coil) shape. Specifically, each coil spring 112 does not have a rotational shaft unlike a transporting member 152 (see FIG. 4) having a rotational shaft 152A, which will be described later, and has a shape allowing the waste toner to pass through the center portion thereof. In other words the shape of each coil spring 112 allows the waste toner to fall down in the tubular member 111. Each coil spring 112 is caused to reciprocate inside the tubular member 111 by the first motor M1 so as to break down the waste toner having agglomerated inside the tubular member 111 or to remove the waste toner from the inner wall of the tubular member 111.

The second transporting mechanism 120 includes a tubular member 121. The tubular member 121 is disposed to extend in an arrangement direction of the image forming units 30T, 30P, 30Y, 30M, 30C, and 30K (in the horizontal direction, approximately), is connected to the tubular members 111 and the discharging part 170, and forms a transport path for the waste toner. In addition, the second transporting mechanism 120 further includes the transporting member 122 and a second motor M2. The transporting member 122 is disposed inside the tubular member 121, and transports the waste toner having been transported from the first transporting mechanisms 110 and the waste toner having been discharged from the discharging part 170. The second motor M2 rotationally drives the transporting member 122. Note that the transporting member 122 is similarly configured to the transporting member 152 described later (see FIG. 4).

The third transporting mechanism 130 includes a tubular member 131. The tubular member 131 is disposed to extend in the up and down direction (in the vertical direction, approximately), is connected to the tubular member 121, and forms a transport path for the waste toner. In addition, the third transporting mechanism 130 further includes a coil spring 132 and a third motor M3. The coil spring 132 is provided inside the tubular member 131 and is reciprocatable along the tubular member 131. The third motor M3 drives to reciprocate coil spring 132.

The tubular member 131 is provided to extend in the up and down direction (the approximately vertical direction). Accordingly, the waste toner having been transported by the second transporting mechanism 120 falls down inside this tubular member 131.

The coil spring 132 is formed of a wire, and has a helical (coil) shape, similarly to the above-mentioned coil springs 112. Specifically, the coil spring 132 does not have a rotational shaft, and has a shape allowing the waste toner to pass through the center portion thereof, similarly to the above-mentioned configuration. In other words, the shape of the coil spring 132 allows the waste toner to fall down in the tubular member 131. The coil spring 132 is caused to reciprocate inside the tubular member 131 by the third motor M3 so as to break down the waste toner having agglomerated inside the tubular member 131 or to remove the waste toner from the inner wall of the tubular member 131.

Figure 3:
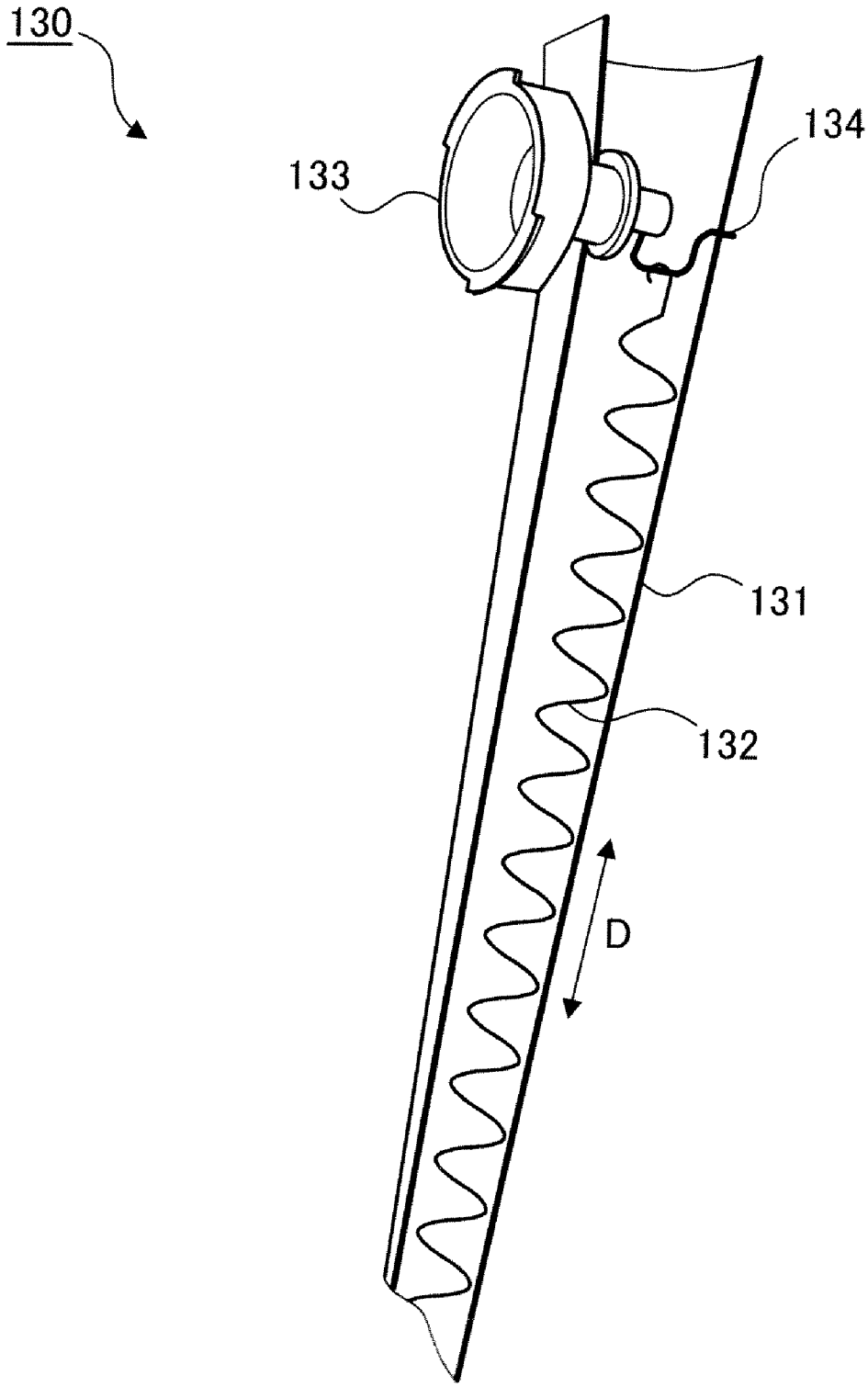
FIG. 3 is a diagram showing a reciprocation mechanism that causes the coil spring to reciprocate.

Note that, the reciprocation of the coil spring 132 is achieved by, for example, a configuration shown in FIG. 3.

Here, FIG. 3 is a diagram showing a reciprocation mechanism that causes the coil spring 132 to reciprocate. As shown in FIG. 3, the third transporting mechanism 130 includes a rotating member 133 and a driving member 134. The rotating member 133 is rotated by the third motor M3 (see FIG. 2). One end portion of the driving member 134 is attached to the rotating member 133, while an upper end portion of the coil spring 132 is attached to the driving member 134. The driving member 134 is formed in a crank shape. In addition, the driving member 134 is configured so that an attachment portion thereof to which the coil spring 132 is attached passes a position eccentric to the center of the axis of the rotating member 133 when the third motor M3 is driven. Accordingly, once the third motor M3 is started to be driven, the coil spring 132 is caused to reciprocate along the tubular member 131

(see an arrow D) by the driving member 134. Note that, although a description has been omitted above, each of the coil springs 112 in the first transporting mechanisms 110 (see FIG. 2) is also caused to reciprocate by the same mechanism as that shown in FIG. 3.

Referring back to FIG. 2 again, the transporting mechanism 100 will be further described.

The fourth transporting mechanism 140 includes a tubular member 141 that forms a transport path for the waste toner. The tubular member 141 is disposed to intersect (to be orthogonal to) the tubular member 131 in the third transporting mechanism 130. In other words, the tubular member 141 is arranged to extend in the approximately horizontal direction. Moreover, although not illustrated, the fourth transporting mechanism 140 includes a transporting member that is disposed inside the tubular member 141, and that transports the waste toner from the third transporting mechanism 130. Further, the fourth transporting mechanism 140 includes a fourth motor M4 that rotationally drives this transporting member. Here, the transporting member disposed inside the tubular member 141 has a similar configuration to that of the transporting member 152 described later (see FIG. 4).

The fifth transporting mechanism 150, functioning as a transporting section, includes a tubular member 151 that forms a transport path for the waste toner (a storage path for storing the waste toner). The tubular member 151 is disposed below the tubular member 141 in the fourth transporting mechanism 140, and also is arranged parallel to the tubular member 141. The fifth transporting mechanism 150 further includes a transporting member 152 and a fifth motor M5. The transporting member 152 is disposed inside the tubular member 151, and transports the waste toner from the fourth transporting mechanism 140. The fifth motor M5 rotationally drives the transporting member 152.

Figure 4:
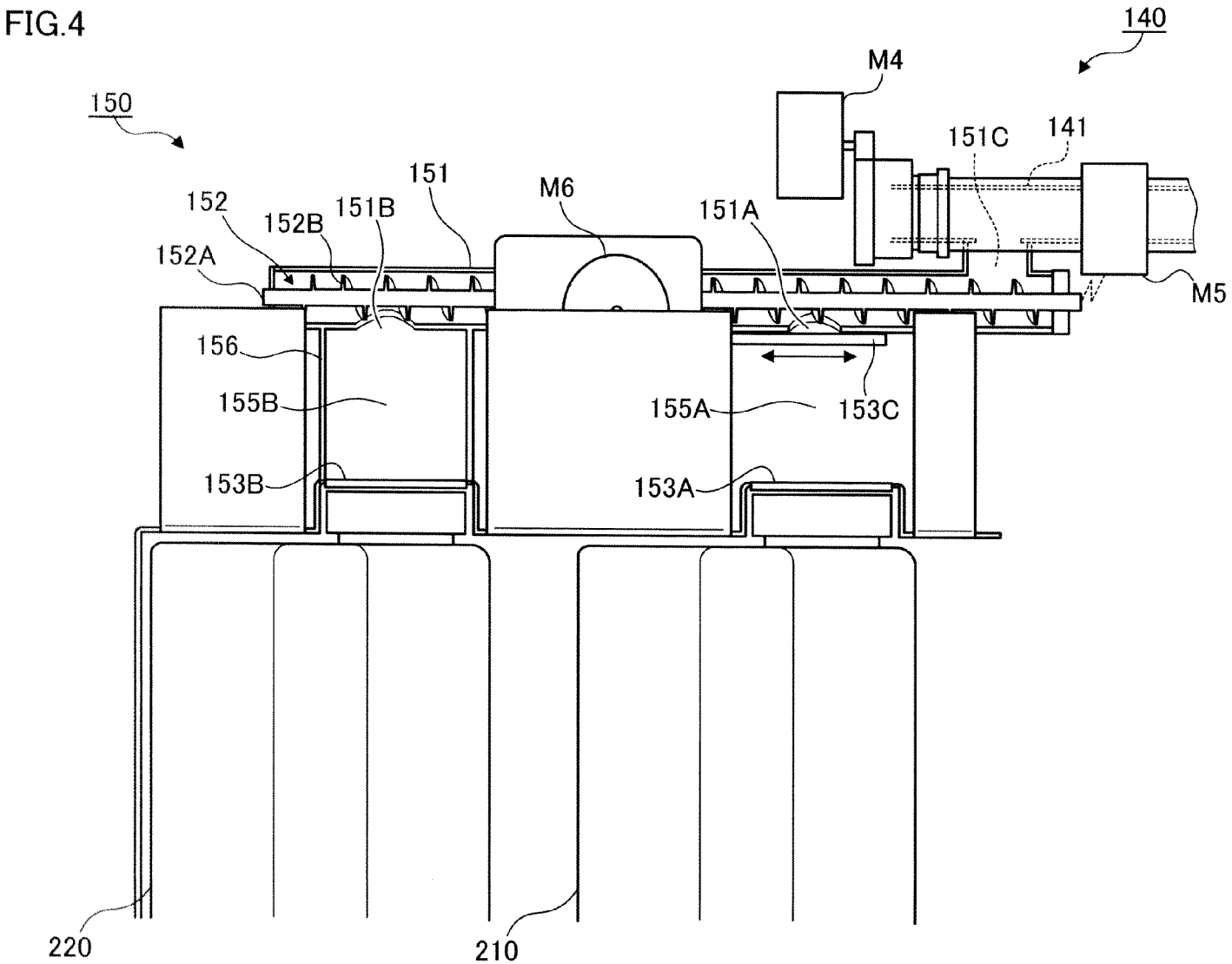
FIG. 4 is an enlarged view showing the fifth transporting mechanism.

Here, FIG. 4 is an enlarged view showing the fifth transporting mechanism 150. With reference to FIG. 4, the fifth transporting mechanism 150 will be further described.

As described above, the fifth transporting mechanism 150 includes the tubular member 151 that forms the transport path for the waste toner. In addition, the fifth transporting mechanism 150 includes the transporting member 152 that is disposed inside the tubular member 151, and that transports the waste toner from the fourth transporting mechanism 140.

The transporting member 152 includes a rotational shaft 152A that is rotated by the fifth motor M5, and ridge portions 152B that are provided to protrude from the rotational shaft 152A. The ridge portions 152B are provided on the periphery of the rotational shaft 152A in a fin form, and are also provided in a helical shape (screw shape) along the axis of the rotational shaft 152A.

The tubular member 151 includes a receiving port 151C that receives the waste toner having been transported by the fourth transporting mechanism 140. The tubular member 151 also includes a first discharge outlet 151A (a first discharging part). Through the first discharge outlet 151A, the waste toner having been received by the receiving port 151C and then transported by the transporting member 152 is discharged to the first storing container 210. In addition, the tubular member 151 includes a second discharge outlet 151B (a second discharging part). Through the second discharge outlet 151B, the waste toner having been received by the receiving port 151C and then transported by the transporting member 152 is discharged to the second storing container 220.

In the present exemplary embodiment, the receiving port 151C is provided at an upper portion in one end portion of the tubular member 151. Moreover, the second discharge outlet 151B is provided at a lower portion in the other end portion of the tubular member 151. Further, the first discharge outlet 151A is provided at a lower portion of the tubular member 151 between the second discharge outlet 151B and the receiving port 151C. In other words, the first discharge outlet 151A, the second discharge outlet 151B, and the receiving port 151C are provided in the following order: the receiving port 151C, the first discharge outlet 151A, and the second discharge outlet 151B, from the upstream side to the downstream side in the transporting direction of the waste toner.

In addition, the fifth transporting mechanism 150 includes a first through path 155A below the first discharge outlet 151A. The waste toner having been discharged from the first discharge outlet 151A falls down and passes through the first through path 155A. Moreover, the fifth transporting mechanism 150 includes a second through path 155B below the second discharge outlet 151B. The waste toner having been discharged from the second discharge outlet 151B falls down and passes through the second through path 155B. Further, the fifth transporting mechanism 150 includes a second tubular member 156 that is formed integrally with the tubular member 151 and that forms the second through path 155B.

Furthermore, the fifth transporting mechanism 150 includes a first shutter member 153A between the first through path 155A and the first storing container 210, and a second shutter member 153B between the second through path 155B and the second storing container 220.

The first shutter member 153A slides in conjunction with the mounting and removing of the first storing container 210. When the first storing container 210 is mounted, the first shutter member 153A opens an opening that is formed above the first storing container 210. On the other hand, when the first storing container 210 is removed, the first shutter member 153A closes the opening. The second shutter member 153B slides in conjunction with the mounting and removing of the second storing container 220. When the second storing container 220 is mounted, the second shutter member 153B opens an opening that is formed above the second storing container 220. On the other hand, when the second storing container 220 is removed, the second shutter member 153B closes the opening.

In addition, the fifth transporting mechanism 150 includes a third shutter member 153C that is slidably provided below the first discharge outlet 151A. Moreover, the fifth transporting mechanism 150 includes a sixth motor M6 that causes the third shutter member 153C to slide. When located at a position below the first discharge outlet 151A, the third shutter member 153C shuts off (closes) the first discharge outlet 151A. Then, when caused to slide from the position by the sixth motor M6, the third shutter member 153C opens the first discharge outlet 151A.

When the first discharge outlet 151A is shut off by the third shutter member 153C, the transporting member 152 transports the waste toner having been received by the receiving port 151C to the second discharge outlet 151B while causing the waste toner to pass over the first discharge outlet 151A. On the other hand, when the first discharge outlet 151A is opened, the waste toner falls down through the first discharge outlet 151A. Accordingly, the transporting member 152 transports the waste toner having been received by the receiving port 151C to the first discharge outlet 151A.

Figure 5:
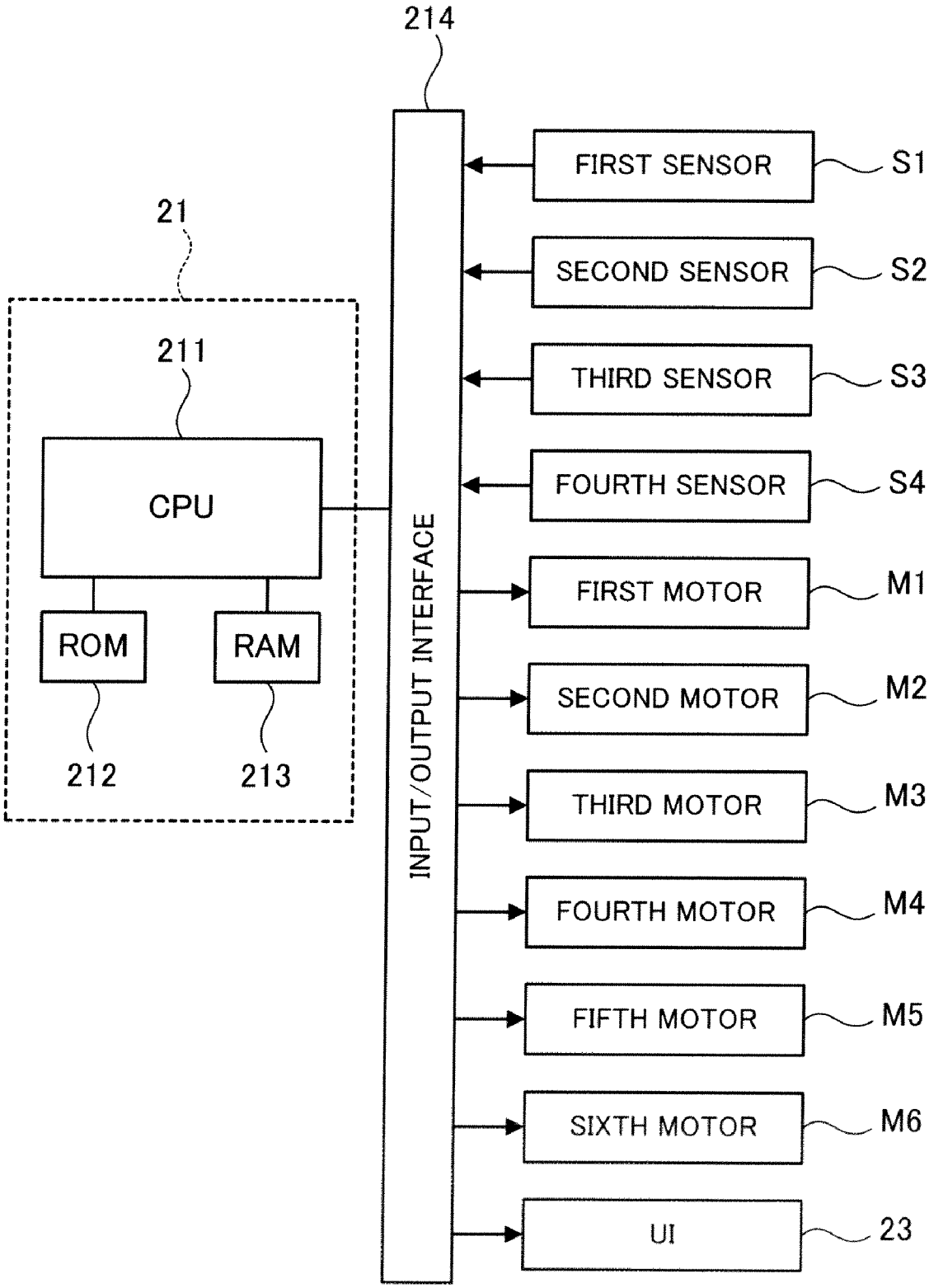
FIG. 5 is a diagram showing a control block of the controller.

Here, FIG. 5 is a diagram showing a control block of the controller 21. Note that, FIG. 5 shows only the block concerning the transportation of the waste toner.

The controller 21 includes a central processing unit (CPU) 211, a read only memory (ROM) 212, and a random access memory (RAM) 213. The CPU 211 of the controller 21 performs processing for the transportation of the waste toner while exchanging data with the RAM 213, in accordance with a program stored in the ROM 212.

Here, the controller 21 receives outputs from first to fourth sensors S1 to S4 via an input/output interface 214. In addition, the controller 21 controls the first to sixth motors M1 to M6, and the UI 23 via the input/output interface 214.

Figure 6A:
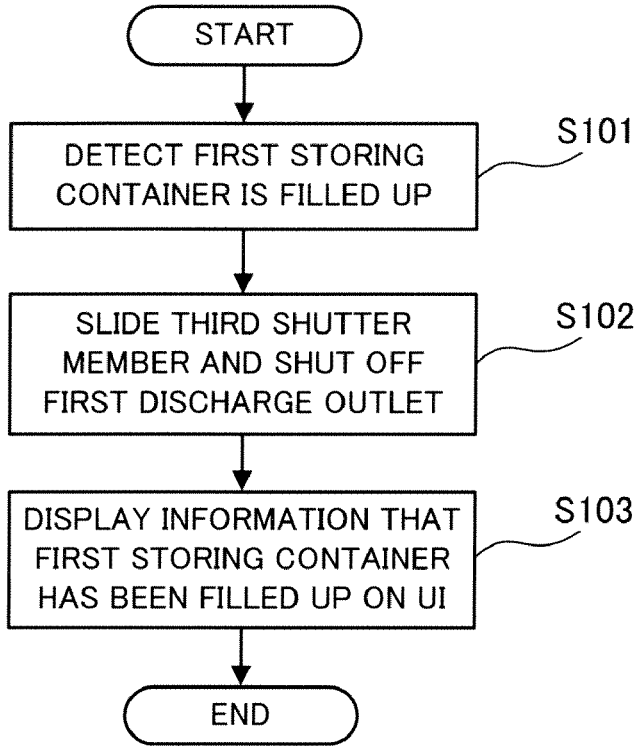
FIGS. 6A and 6B are flowcharts showing the processing performed by the controller when one of the storing containers is filled up with the waste toner.
Figure 6B:
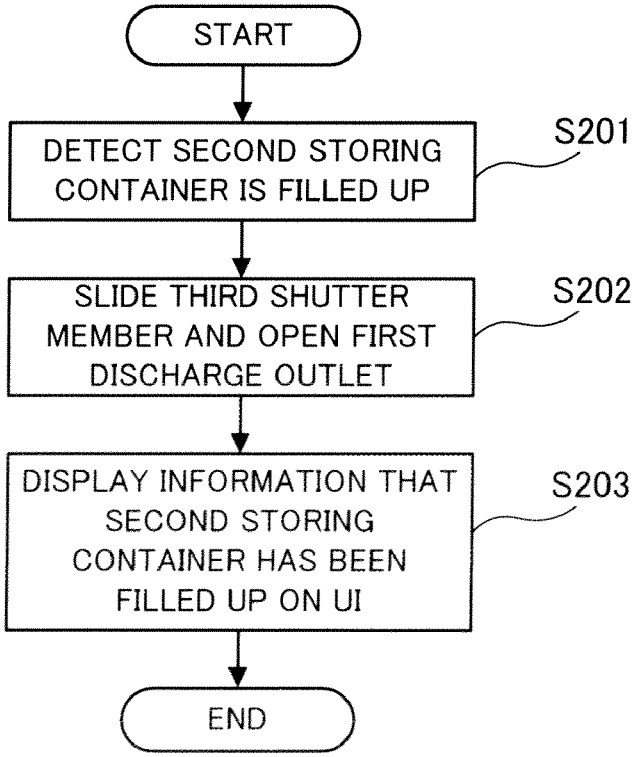

Here, FIGS. 6A and 6B are flowcharts showing the processing performed by the controller 21 when one of the storing containers is filled up with the waste toner. Note that, FIG. 6A shows processing performed by the controller 21 when the first storing container 210 is filled up with the waste toner, while FIG. 6B shows processing performed by the controller 21 when the second storing container 220 is filled up with the waste toner.

First, with reference to FIG. 6A, the processing performed by the controller 21 when the first storing container 210 has been filled up will be described.

While the waste toner is being transported to the first storing container 210 with the first discharge outlet 151A being opened, upon detecting that the first storing container 210 is filled up (Step 101), the controller 21 drives the sixth motor M6 to slide the third shutter member 153C, thereby shutting off the first discharge outlet 151A (Step 102). Accordingly, the waste toner having been received by the receiving port 151C does not fall down through the first discharge outlet 151A but is transported to the second discharge outlet 151B. Then, the waste toner having been transported to the second discharge outlet 151B is stored in the second storing container 220. Note that, the detection that the first storing container 210 is filled up in Step 101 is performed on the basis of the output from the third sensor S3.

Thereafter, the controller 21 causes the UI 23 to display information that the first storing container 210 has been filled up, and the like, after a time T1 passes from the start of the driving of the sixth motor M6, for example (Step 103). Note that, the time T1 may be set to be not less than a time required for the shutting off of the first discharge outlet 151A. In other words, the information that the first storing container 210 has been filled up, and the like, may be displayed after the first discharge outlet 151A is shut off by the third shutter member 153C.

If the information that the first storing container 210 has been filled up, and the like, is displayed before the first discharge outlet 151A is shut off, the first storing container 210 may possibly be removed before the first discharge outlet 151A is shut off. Then, if the first storing container 210 is removed before the first discharge outlet 151A is shut off, the waste toner is discharged from the first discharge outlet 151A without the first storing container 210 being attached. The waste toner discharged from the first discharge outlet 151A is accumulated on the first shutter member 153A. By the way, in a state where the waste toner is accumulated on the first shutter member 153A, scattering or the like of the waste toner having been accumulated may possibly occur when the first storing container 210 is mounted later. For this reason, when it is detected that the first storing container 210 has been filled up, the information that the first storing container 210 has been filled up, and the like, may be displayed after the first discharge outlet 151A is shut off by the third shutter member 153C as described above.

Next, with reference to FIG. 6B, the processing performed by the controller 21 when the second storing container 220 has been filled up will be described.

While the waste toner is being transported to the second storing container 220 with the first discharge outlet 151A being closed, upon detecting that the second storing container 220 is filled up (Step 201), the controller 21 drives the sixth motor M6 to slide the third shutter member 153C, thereby opening the first discharge outlet 151A (Step 202). As a result, the waste toner having been received by the receiving port 151C falls down from the first discharge outlet 151A so as to be stored in the first storing container 210.

In the present exemplary embodiment, even when the first discharge outlet 151A is opened, the waste toner located between the first discharge outlet 151A and the second discharge outlet 151B (the waste toner located downstream of the first discharge outlet 151A in the transporting direction) is transported toward the second discharge outlet 151B by the transporting member 152. Then, the waste toner having been transported to the second discharge outlet 151B is stored in the second storing container 220 through the second discharge outlet 151B.

Then, after a time T2 passes from the detection that the second storing container 220 has been filled up in Step 201, for example, the controller 21 causes the UI 23 to display information that the second storing container 220 has been filled up, and the like (Step 203).

Here, the information that the second storing container 220 has been filled up, and the like, may be displayed after the waste toner located between the first discharge outlet 151A and the second discharge outlet 151B is transported by the transporting member 152 and stored in the second storing container 220. In other words, the time T2 may be set so that the information that the second storing container 220 has been filled up, and the like, are displayed after the waste toner located between the first discharge outlet 151A and the second discharge outlet 151B is stored in the second storing container 220.

If the information that the second storing container 220 has been filled up, and the like, are displayed immediately after the detection that the second storing container 220 has been filled up, the second storing container 220 may be removed early in some cases. If the second storing container 220 is removed early, the waste toner located between the first discharge outlet 151A and the second discharge outlet 151B is transported to the second discharge outlet 151B without the second storing container 220 being attached. In this case as well, the waste toner is accumulated on the upper portion of the second shutter member 153B. As a result, as in the above-described case where the first storing container 210 has been filled up, scattering or the like of the waste toner having been accumulated may possibly occur when the second storing container 220 is mounted later.

For this reason, when it is detected that the second storing container 220 has been filled up, the information showing that the second storing container 220 has been filled up, and the like, may be displayed after the waste toner having been located between the first discharge outlet 151A and the second discharge outlet 151B is stored in the second storing container 220, as in the above-described case, so that the second storing container 220 is prevented from being removed before the waste toner is stored in the second storing container 220. Note that, in the present exemplary embodiment, the second storing container 220 is detected to have been filled up before completely filled up with the waste toner, in order that the waste toner having been located between the first discharge outlet 151A and the second discharge outlet 151B is allowed to be stored in the second storing container 220 even after the detection that the second storing container 220 has been filled up.

Next, the processing performed by the controller 21 when any one of the storing containers is removed from the sheet outputting unit 1C (see FIG. 1) will be described.

Figure 7A:
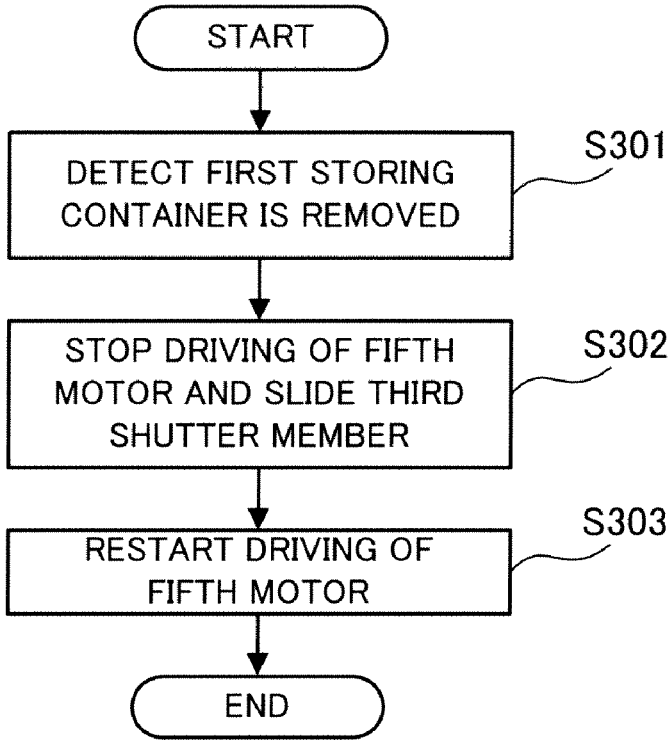
FIGS. 7A and 7B show the processings performed by the controller when the storing container is removed.
Figure 7B:
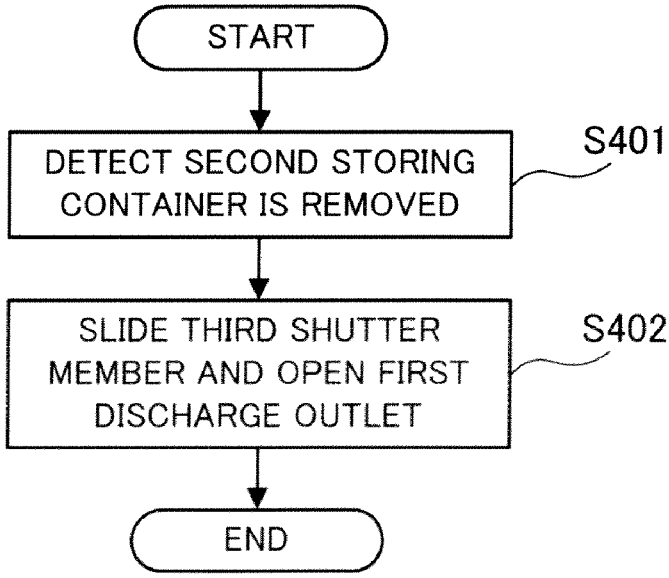

Each of FIGS. 7A and 7B shows the processing performed by the controller 21 when the storing container is removed.

First, with reference to FIG. 7A, the processing performed by the controller 21 when the first storing container 210 is removed will be described.

Upon detecting that the first storing container 210 is removed while the waste toner is being transported to the first storing container 210 with the first discharge outlet 151A being opened (Step 301), the controller 21 stops the driving of the fifth motor M5 and starts the driving of the sixth motor M6 so as to slide the third shutter member 153C at the same time (Step 302). Then, after, for example, a time T3 passes from the stop of the driving of the fifth motor M5, the controller 21 restarts the driving of the fifth motor M5 (Step 303). Note that, the detection of the removal of the first storing container 210 is performed on the basis of the output from the first sensor S1.

With the above processing, the waste toner having been transported from the fourth transporting mechanism 140 is transported to the second discharge outlet 151B without falling down from the first discharge outlet 151A. Then, the waste toner having been transported to the second discharge outlet 151B is stored in the second storing container 220.

Note that, even when the third shutter member 153C is caused to slide as in Step 302, it is often difficult to immediately close the first discharge outlet 151A. Accordingly, if the driving of the fifth motor M5 is continued without being stopped, the waste toner may possibly be discharged from the first discharge outlet 151A. Then, in this case, the waste toner may possibly be accumulated on the first shutter member 153A and the like, as in the above-described case. For this reason, when the first storing container 210 is removed, the driving of the fifth motor M5 is stopped in addition to the closing of the first discharge outlet 151A.

The processing of closing the first discharge outlet 151A is performed as described above also when the first storing container 210 has been filled up. However, in the processing performed when the first storing container 210 has been filled up, only the third shutter member 153C is caused to slide without stopping the driving of the fifth motor M5. The driving of the fifth motor M5 is not stopped when the first storing container 210 has been filled up because of the following reason. Specifically, since the first storing container 210 is located below the first discharge outlet 151A, even when the waste toner is discharged from the first discharge outlet 151A, the waste toner thus discharged is allowed to be stored in the first storing container 210.

In the above processing, the sixth motor M6 is driven at the same time when the driving of the fifth motor M5 is stopped in Step 302. However, the present invention is not limited to such processing. For example, the driving of the sixth motor M6 may be started after the driving of the fifth motor M5 is stopped. Alternatively, the driving of the fifth motor M5 may be stopped after the driving of the sixth motor M6 is started.

Further, the driving of the fifth motor M5 is stopped in Step 302. Alternatively, for example, the speed of the fifth motor M5 may be reduced so that the rotational speed of the transporting member 152 is reduced (the output of the transporting member 152 is reduced). Moreover, the time T3 that determines the timing to restart the driving of the fifth motor M5 may be set to be not less than a time required for the first discharge outlet 151A to be closed. In other words, the driving of the fifth motor M5 may be restarted after the first discharge outlet 151A is closed by the third shutter member 153C.

In addition to the stop of the driving of the fifth motor M5, the driving of the fourth motor M4 (the fourth transporting mechanism 140) may be stopped.

While the driving of the fourth motor M4 is stopped, the waste toner is successively transported by the second transporting mechanism 120 (see FIG. 2) that is located upstream in the transporting direction. The waste toner transported by the second transporting mechanism 120 is successively accumulated inside the tubular member 131 (see FIG. 2) in the third transporting mechanism 130. In the present exemplary embodiment, the amount of the waste toner to be transported per unit time in the fourth transporting mechanism 140 is set to be not less than the amount of the waste toner to be transported per unit time in the second transporting mechanism 120. Accordingly, during the normal operation, the waste toner is basically not accumulated inside the tubular member 131. In other words, during the normal operation, the tubular member 131 has enough space for the accumulation of the waste toner. Then, once the driving of the fourth motor M4 (the fourth transporting mechanism 140) is stopped as described above, the waste toner coming from the upstream side in the transporting direction is accumulated inside the tubular member 131.

Subsequently, with reference to FIG. 7B, the processing performed by the controller 21 when the second storing container 220 is removed will be described.

Upon detecting that the second storing container 220 is removed while the waste toner is being transported to the second storing container 220 with the first discharge outlet 151A being closed (Step 401), the controller 21 causes the third shutter member 153C to slide so as to open the first discharge outlet 151A (Step 402). The waste toner having been received by the receiving port 151C (the waste toner to be transported from the upstream of the first discharge outlet 151A in the transporting direction of the waste toner) is thus caused to fall down from the first discharge outlet 151A so as to be stored in the first storing container 210.

Even though the first discharge outlet 151A is opened as described above, the waste toner located between the first discharge outlet 151A and the second discharge outlet 151B at the time of opening the first discharge outlet 151A is transported to the second discharge outlet 151B by the transporting member 152. Then, in the case of this situation where the second storing container 220 has been removed, the waste toner having been transported falls down from the second discharge outlet 151B so as to be accumulated on the second shutter member 153B. In other words, the waste toner is accumulated (stored) inside the second tubular member 156 (inside the second through path 155B).

In this respect, in the present exemplary embodiment, the capacity of an accumulating space for the waste toner (an accumulating part and a powder storage part) formed by the second tubular member 156 is set to be not less than the volume of the waste toner that is located between the first discharge outlet 151A and the second discharge outlet 151B and that is to be discharged from the second discharge outlet 151B. In other words, the capacity of the accumulating space for the waste toner formed by the second tubular member 156 is set to be not less than the volume of the waste toner to be discharged from the second discharge outlet 151B after the first discharge outlet 151A is opened. In the present exemplary embodiment, this configuration allows all of the waste toner that is to be discharged from the second discharge outlet 151B to be stored in the accumulating space.

In other words, the accumulating space has such a capacity that is enough for accumulating (storing) the waste toner that is located between the first discharge outlet 151A and the second discharge outlet 151B when the first discharge outlet 151A is opened and that is to be transported to the second discharge outlet 151B. If described further, the capacity of the accumulating space is set to be not less than the volume of the waste toner storable in a space (hereinafter, referred to as a "space A") that is a space inside the tubular member 151 between the first discharge outlet 151A and the second discharge outlet 151B. Moreover, when the volume of a part, located between the first discharge outlet 151A and the second discharge outlet 151B, of the transporting member 152 is represented by a volume B, the capacity of the accumulating space is set to be not less than a value obtained by subtracting the volume B from the capacity of the space A.

Here, if the capacity of the accumulating space is small, the waste toner may not be completely stored in the accumulating space. As a result, there occurs a state where the waste toner is not discharged from the second discharge outlet 151B, that is, a state where the waste toner remains inside the tubular member 151. In such a state, the transporting member 152 may transport the waste toner to an end portion (a left end portion in FIG. 4) of the tubular member 151, for example, which may possibly lead to the agglomeration of the waste toner, the clogging of the waste toner, the breakage of the transporting member 152, and the like.

In this respect, while the waste toner is caused to be accumulated on the second shutter member 153B in the present exemplary embodiment, the capacity of the accumulating space for the waste toner is set to be not less than the volume of the waste toner to be discharged from the second discharge outlet 151B as described above, so that all the waste toner is completely discharged from the tubular member 151. Here, the waste toner having been accumulated inside the second tubular member 156 falls down (is discharged) in accordance with the mounting of the second storing container 220, so as to be stored in the second storing container 220.

Note that, the motors (the fourth motor M4 and fifth motor M5) are provided respectively to the fourth transporting mechanism 140 and the fifth transporting mechanism 150 in the present exemplary embodiment. Alternatively, the following configuration may be employed. Specifically, the transporting member 152 in the fifth transporting mechanism 150 may be rotationally driven by the fourth motor M4.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming section that forms an image on a recording medium;

a storing container that is attachably and detachably provided and that stores waste powder having been discarded and transported from the image forming section;

a transport path through which the waste powder from the image forming section is transported;

a first discharging part that is provided so as to be allowed to be shut off, and that discharges, to an outside of the transport path, the waste powder having been transported through the transport path;

a second discharging part that is provided downstream of the first discharging part in a transporting direction of the waste powder and that discharges, to the storing container, the waste powder having been transported through the transport path;

a powder storage part that stores the waste powder having been transported through the transport path and discharged from the second discharging part, when the storing container is removed; and a controller that causes the first discharging part having been shut off to be opened when the storing container is removed, and that causes the waste powder transported from an upstream of the first discharging part in the transporting direction of the waste powder to be discharged from the first discharging part, wherein the powder storage part has a capacity that is enough for storing the waste powder located downstream of the first discharging part in the transporting direction of the waste powder when the first discharging part is caused to be opened by the controller.

2. The image forming apparatus according to claim 1, wherein the powder storage part discharges, to the storing container, the waste powder having been stored, when the storing container is mounted.

3. The image forming apparatus according to claim 1, wherein the controller displays information that the storing container is filled up, while causing the first discharging part having been shut off to be opened, when a predetermined amount of the waste powder is stored in the storing container, and the controller displays the information that the storing container is filled up, after the waste powder located downstream of the first discharging part in the transporting direction of the waste powder is stored in the storing container when the first discharging part is caused to be opened.

4. The image forming apparatus according to claim 1, further comprising:

a different storing container that is attachably and detachably provided and that stores the waste powder discharged from the first discharging part, wherein the controller displays information that the different storing container is filled up, while causing the first discharging part having been opened to be shut off, when a predetermined amount of the waste toner is stored in the different storing container, and the controller displays the information that the different storing container is filled up, after causing the first discharging part to be shut off.

5. An apparatus comprising:

a storing container that is attachably and detachably provided and that stores powder having been transported;

a transporting section that includes a storage path storing the powder and that transports the powder along the storage path;

a first discharging part that is provided so as to be allowed to be shut off, and that discharges, to an outside of the storage path, the powder having been transported by the transporting section;

a second discharging part that is provided downstream of the first discharging part in a transporting direction of the powder and that discharges, to the storing container from the storage path, the powder having been transported by the transporting section;

a controller that causes the first discharging part having been shut off to be opened when the storing container is removed, and that causes the powder transported from an upstream of the first discharging part in the transporting direction of the powder to be discharged from the first discharging part; and a powder storage part that stores the powder located downstream of the first discharging part in the transporting direction of the powder and discharged from the second discharging part when the first discharging part is caused to be opened by the controller, wherein the powder storage part has a capacity that is not less than an amount of the powder allowed to be stored in the storage path between the first discharging part and the second discharging part.

6. The apparatus according to claim 5, wherein the powder storage part discharges, to the storing container, the powder having been stored, when the storing container is mounted.

7. The apparatus according to claim 5, further comprising:

a different storing container that is attachably and detachably provided and that stores the powder discharged from the first discharging part, wherein the controller causes the transporting section to be stopped or causes an output of the transporting section to be reduced, while causing the first discharging part having been opened to be shut off, when the different storing container is removed.

8. An image forming apparatus comprising:

an image forming section that forms an image on a recording medium;

a first storing container that is attachably and detachably provided and that stores waste powder having been discarded and transported from the image forming section;

a second storing container that is attachably and detachably provided and that stores waste powder having been discarded and transported from the image forming section;

a transporting part that transports the waste powder from the image forming section;

a first discharging part that discharges, to the first storing container, the waste powder having been transported by the transporting part;

a second discharging part that is provided downstream of the first discharging part in a transporting direction of the waste powder and that discharges, to the second storing container, the waste powder having been transported by the transporting part; and a shutter part that shuts off the first discharging part, wherein the shutter part shuts off the first discharging part when a predetermined amount of the waste powder is stored in the first storing container, and opens the first discharging part when a predetermined amount of the waste powder is stored in the second storing container, and wherein, when a predetermined amount of the waste powder is stored in the second storing container, the transporting part transports, to the second discharging part and for storage in the second storing container, the waste powder located downstream of the first discharging part in the transporting direction of the waste powder, and transports, to the first discharging part and for storage in the first storing container, the waste powder located upstream of the first discharging part in the transporting direction of the waste powder.

9. The image forming apparatus according to claim 8, wherein the shutter part shuts off the first discharging part when the first storing container is removed, and opens the first discharging part when the second storing container is removed.

10. The image forming apparatus according to claim 8, wherein the shutter part shuts off the first discharging part when the first storing container is removed, and wherein the transporting unit stops transporting the waste powder when the first storing container is removed and restarts transporting the waste powder after the shutter part shuts off the first discharging part.

11. The image forming apparatus according to claim 8, further comprising:

a first shutter part that is openably and closably provided between the first discharging part and the first storing container; and a second shutter part that is openably and closably provided between the second discharging part and the second storing container, wherein the first shutter part closes when the first storing container is removed, and the second shutter part closes when the second storing container is removed.

* * * * *